US006389255B1

(12) United States Patent
Sawada et al.

(10) Patent No.: US 6,389,255 B1
(45) Date of Patent: May 14, 2002

(54) CHARGING DEVICE INCLUDING A CHARGING ROLLER, A CHARGING ROLLER CLEANING MEMBER WITH A PRESELECTED LENGTH, AN IMAGE FORMING APPARATUS USING THE CHARGING DEVICE, AND A METHOD OF OPERATING THE DEVICE

(75) Inventors: Akira Sawada; Daisuke Saito, both of Tokyo; Masaharu Furuya, Yokohama, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/630,302

(22) Filed: Jul. 31, 2000

(30) Foreign Application Priority Data

Jul. 29, 1999 (JP) ..... 11-214729

(51) Int. Cl.[7] ..... G03G 15/02
(52) U.S. Cl. ..... 399/176; 399/100
(58) Field of Search ..... 399/176, 168, 399/174, 175, 100

(56) References Cited

U.S. PATENT DOCUMENTS 5,555,079 A * 9/1996 Adachi et al.

FOREIGN PATENT DOCUMENTS

| | | | |
|---|---|---|---|
| JP | 60-83068 | * | 5/1985 |
| JP | 62-264070 A | * | 11/1987 |
| JP | 6-230650 A | * | 8/1994 |
| JP | 7-110618 | | 4/1995 |
| JP | 8-314235 A | * | 5/1995 |
| JP | 7-199604 | | 8/1995 |
| JP | 7-325527 | | 12/1995 |
| JP | 8-110683 A | * | 4/1996 |
| JP | 11-160966 A | * | 6/1999 |
| JP | 11-160966 | | 6/1999 |
| JP | 11-160968 A | * | 6/1999 |
| JP | 11-160968 | * | 6/1999 |
| JP | 2001-42608 | * | 2/2001 |
| JP | 2001-117329 | * | 4/2001 |
| JP | 2001-83892 | * | 7/2001 |

* cited by examiner

*Primary Examiner*—Quana M. Grainger
(74) *Attorney, Agent, or Firm*—Oblon, Spivak, McClelland, Maier & Neustadt, P.C.

(57) ABSTRACT

A charging device and method of operating the device for charging a photoreceptor of an image forming apparatus so that a latent image is formed thereupon to be developed by toner, the device including a charging roller that is configured to constantly contact the photoreceptor with a pressure so as to be rotated by rotations of the photoreceptor and that is configured to charge the photoreceptor, and a charging roller cleaning member that is configured to constantly contact a surface of the charging roller with a pressure so as to remove the toner transferred onto the charging roller from the photoreceptor. A length portion of the charging roller cleaning member along an axial direction of the charging roller is set to be equal to or greater than a width portion of an effective development area in an axial direction of the photoreceptor and smaller than a charging contact width portion of the charging roller with the photoreceptor in the axial direction of the charging roller.

48 Claims, 5 Drawing Sheets

CHARGING DEVICE INCLUDING A CHARGING ROLLER, A CHARGING ROLLER CLEANING MEMBER WITH A PRESELECTED LENGTH, AN IMAGE FORMING APPARATUS USING THE CHARGING DEVICE, AND A METHOD OF OPERATING THE DEVICE

BACKGROUND OF THE INVENTION

1. Field of the Invention

The present invention relates to an image forming apparatus such as a copying machine, a facsimile, a laser printer, or similar image forming apparatus, and more particularly to a charging device including a charging roller and a charging roller cleaning member for use in an image forming apparatus and a method of operating the device.

2. Discussion of the Background

In an image forming apparatus employing an electorophotography process, such as a copying machine, a facsimile, a laser printer, or the like, an increasing number of the image forming apparatuses are made compact by employing an electrophotographic image forming process cartridge wherein a photoreceptor, a developing device, a charging device, etc. are integrally accommodated in a case.

Many of the charging devices provided in such an electrophotographic image forming process cartridge employ a charging roller that contacts the photoreceptor with a pressure and uniformly charges a surface of the photoreceptor by applying a voltage to the charging roller. Typically, in such a charging device, a charging roller cleaning member made of, for example, a sponge or the like, slidably contacts a surface of the charging roller with an appropriate pressure. When the charging roller is rotated by rotation of the photoreceptor, the charging roller cleaning member removes foreign substances, such as toner and paper powder, from the surface of the charging roller, which are transferred onto the charging roller from the photoreceptor.

As an example of the above-described charging roller cleaning member, Japanese Laid-Open Patent Publication No. 7-325527 describes a cleaning roller that contacts a surface of a charging roller so as to clean the charging roller. The charging roller contacts a drum-shaped photoreceptor and is rotated by rotation of the photoreceptor. The cleaning roller includes a metallic core and a rubber layer covering a circumference of the metallic core. In addition, a string-shaped member formed of, such as, a sponge, a fiber material, or a soft rubber, etc. is spirally wound around the surface of the rubber layer. A length portion of the cleaning roller along an axial direction of the charging roller (i.e., a width portion of an effective cleaning area in an axial direction of the cleaning roller) is set to be greater than a charging contact width portion of the charging roller with the photoreceptor in the axial direction of the charging roller.

However, deterioration of the charging property of the charging roller typically tends to be caused when the above-described length portion of the cleaning roller is set to be equal to or greater than the above-described charging contact width portion of the charging roller with the photoreceptor. Further details are described hereinafter with reference to a background charging device illustrated in FIG. 4 which employs a charging roller cleaning member made of a sponge. In this background charging device, a charging roller 32 pressingly contacts a drum-shaped photoreceptor 31. The charging contact width of the charging roller 32 with the photoreceptor 31 in an axial direction of the charging roller 32 is indicated by a reference character Wch in FIG. 4 (hereinafter referred to as a charging roller width Wch). Further, a charging roller cleaning member 33 made of a sponge contacts the charging roller 32 and applies pressure along the axial direction of the charging roller 32 as indicated by double-headed arrow A in FIG. 4.

In this background charging device of FIG. 4, a length L1 of the charging roller cleaning member 33 along the axial direction of the charging roller 32 is set to be greater than the charging contact width Wch. Further, the charging contact width Wch is set to be greater than a width Wde of an effective development area in an axial direction of the photoreceptor 31 (hereinafter referred to as an effective development width Wde). The effective development area of the photoreceptor 31 is defined by diagonal lines in FIG. 4.

In the above-described background charging device, when a sequence of image forming steps are performed by an electrophotographic process, respective end portions 32*a*, 32*b* of the charging roller 32 are likely to be stained by scattered toner dropped from a cleaning device (not shown) of the image forming apparatus that removes residual toner remaining on the photoreceptor 31. As far as the scattered toner is not caused to enter a width of a part of the charging roller 32 corresponding to the effective development area of the photoreceptor 31, image quality is not deteriorated. However, when scattered toner such as an aggregate small amount of toner mass is dropped from the cleaning device on respective end portions 32*a* and 32*b* of the charging roller 32, and when the charging roller 32 is rotated by rotations of the photoreceptor 31, the aggregate small amount of toner mass may be pressed and spread by the pressure between the charging roller 32 and the charging roller cleaning member 33 into the width of the part of the charging roller 32 corresponding to the effective development area of the photoreceptor 31. Generally, the charging roller cleaning member 33 removes and holds foreign substances, such as toner and paper powder, from the surface of the charging roller 32, which are transferred onto the charging roller 32 from the photoreceptor 31. However, when a scattered toner such as an aggregated small amount of toner mass is dropped on the charging roller 32, the amount of toner exceeds a predetermined amount which can be held by the charging roller cleaning member 33, so that the charging roller cleaning member 33 cannot remove and hold the same therein. The toner remains on the charging roller 32 and is pressed and spread into the width portion of the part of the charging roller 32 corresponding to the effective development area of the photoreceptor 31 as described above. Then, the toner is fused on the surface of the charging roller 32 due to frictional heat and thereby adheres thereto. As a result, deterioration of charging property of the charging roller 32 is caused by the toner, and thereby deterioration of image quality, such as background fouling and density unevenness of toner image, occurs according to developing methods.

SUMMARY OF THE INVENTION

The present invention has been made in view of the above-discussed and other problems, and an object of the present invention is to address these problems.

The preferred embodiments of the present invention provide a novel charging device wherein deterioration of charging property of a charging roller due to a scattering toner can be prevented.

The preferred embodiments of the present invention provide a novel electrophotographic image forming process cartridge wherein deterioration of charging property of a charging roller due to a scattering toner can be prevented.

The preferred embodiments of the present invention provide a novel image forming apparatus wherein deterioration of charging property of a charging roller due to a scattering toner can be prevented.

These and other objects are achieved according to the present invention by providing a novel charging device for charging a photoreceptor of an image forming apparatus so that a latent image is formed thereupon to be developed by toner, the charging device including a charging roller that is configured to constantly contact the photoreceptor with a pressure so as to be rotated by rotations of the photoreceptor and that is configured to charge the photoreceptor, and a charging roller cleaning member that is configured to constantly contact a surface of the charging roller with a pressure so as to remove the toner transferred onto the charging roller from the photoreceptor. A length portion of the charging roller cleaning member along an axial direction of the charging roller is set to be equal to or greater than a width portion of an effective development area in an axial direction of the photoreceptor and smaller than a charging contact width of the charging roller with the photoreceptor in the axial direction of the charging roller.

According to another preferred embodiment of the present invention, a charging device for charging a photoreceptor of an image forming apparatus so that a latent image is formed thereupon to be developed by toner, includes a charging roller that is configured to constantly contact the photoreceptor with a pressure so as to be rotated by rotation of the photoreceptor and that is configured to charge the photoreceptor, and a charging roller cleaning member that is configured to constantly contact a surface of the charging roller with a pressure and to reciprocate in an axial direction of the charging roller so as to remove the toner transferred onto the charging roller from the photoreceptor. A maximum contact width portion of the charging roller cleaning member with the charging roller along the axial direction of the charging roller is set to be equal to or greater than a width portion of an effective development area in an axial direction of the photoreceptor and smaller than a charging contact width portion of the charging roller with the photoreceptor in the axial direction of the charging roller.

According to the present invention, the charging roller cleaning member may include a sponge material.

Other objects, features, and advantages of the present invention will become apparent from the following detailed description when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
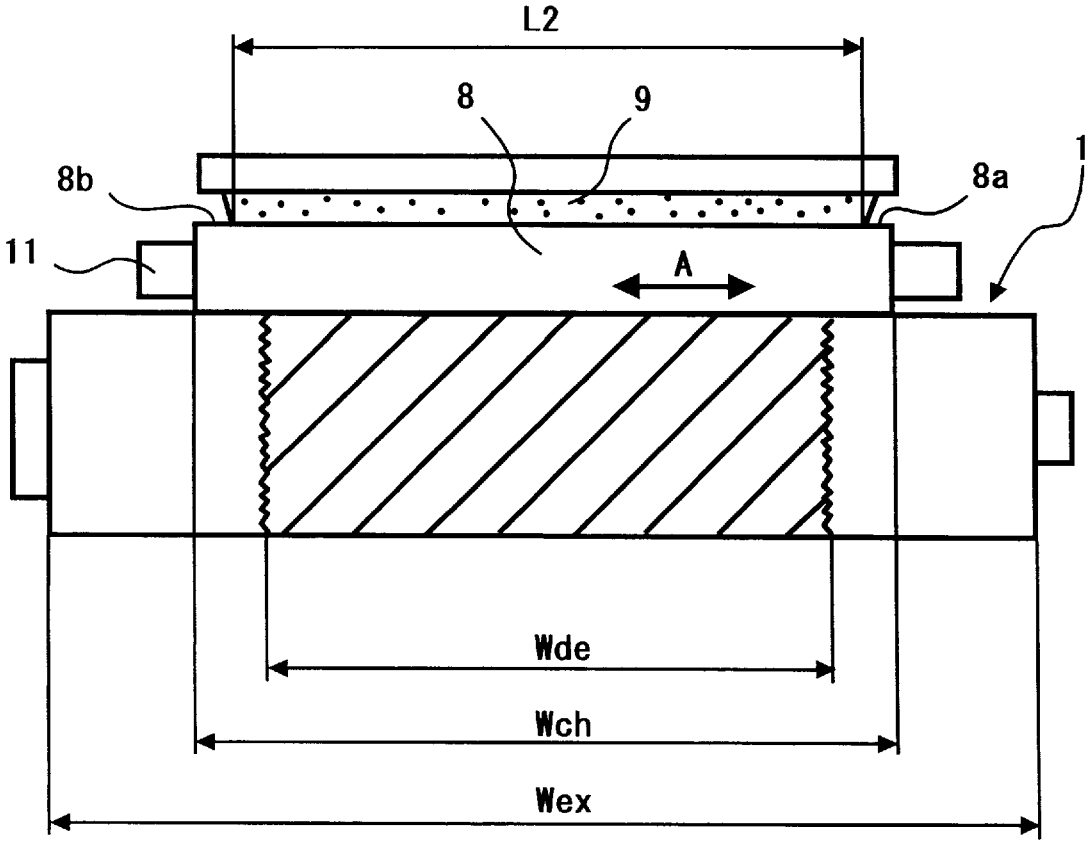
FIG. 1 is a schematic view illustrating a charging device and a photoreceptor according to a first preferred embodiment of the present invention.

Preferred embodiments of the present invention are described in detail referring to the drawings, wherein like reference numerals designate identical or corresponding parts throughout the several views.

Figure 2A:
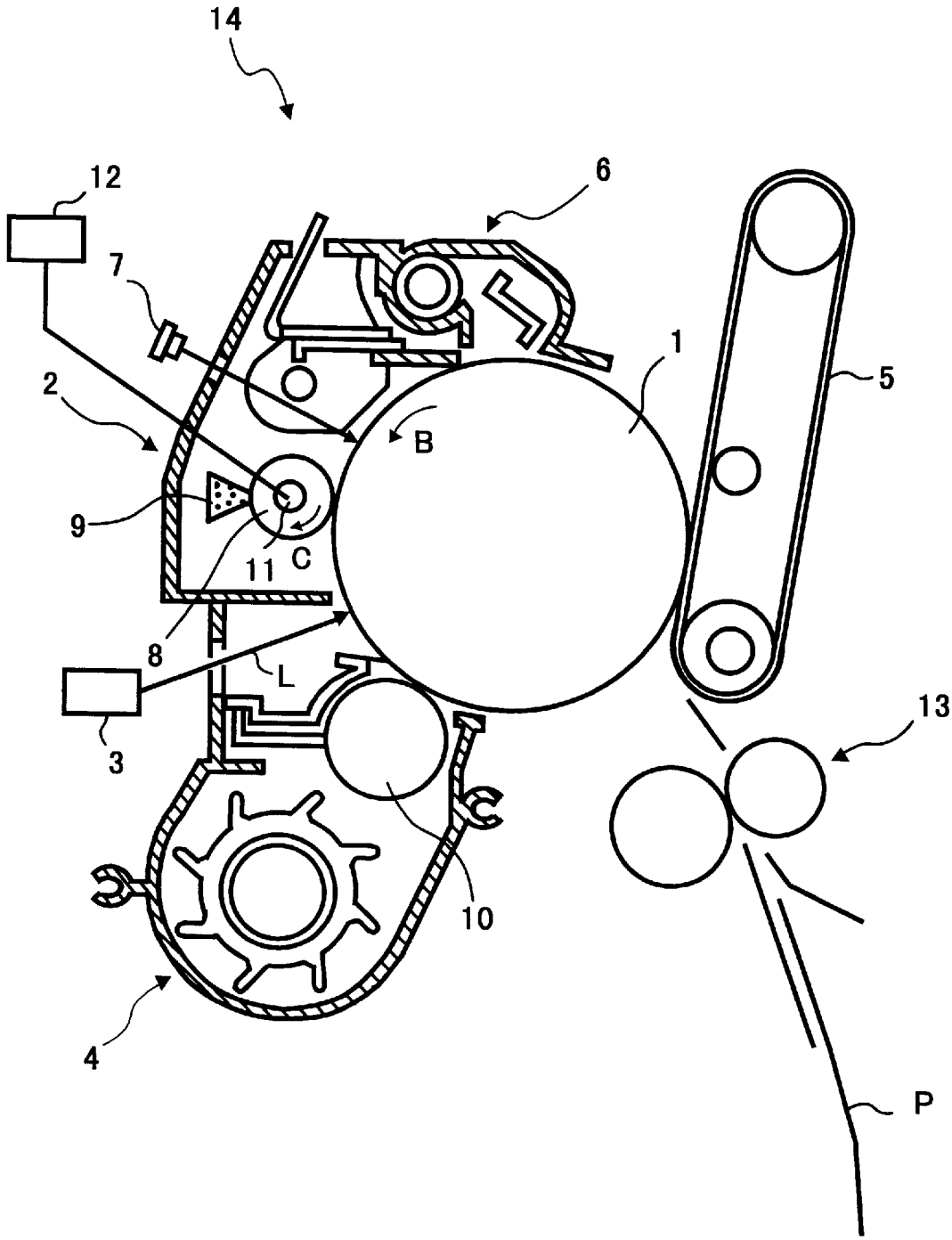
FIG. 2A is a schematic view illustrating an image forming section of an image forming apparatus including the charging device of the present invention.

Referring to FIG. 2A, an image forming section of the image forming apparatus includes a drum-shaped photoreceptor 1 serving as an image bearing member that is rotated in a direction indicated by arrow B. Arranged around the photoreceptor 1 are a charging device 2, an exposing device 3 that forms an electrostatic latent image on the photoreceptor 1 by illuminating a laser light L, and a developing device 4 that develops the electrostatic latent image into a visible toner image.

Also arranged around the photoreceptor 1 are a transfer belt 5 that transfers a toner image formed by the developing device 4 onto a transfer sheet P, a cleaning device 6 that removes residual toner remaining on the photoreceptor 1 after the toner image is transferred onto the transfer sheet P, and a discharging lamp 7 that removes residual charge on the photoreceptor 1.

The charging device 2 includes a charging roller 8 and a charging roller cleaning member 9. The charging roller 8 charges the photoreceptor 1 while being constantly in pressing-contact with the surface of the photoreceptor 1 and being rotated in a direction indicated by arrow C by rotation of the photoreceptor 1. The charging roller cleaning member 9 is made of, for example, a sponge, and constantly contacts the surface of the charging roller 8 with a pressure so as to remove foreign substances, such as toner and paper powder, from the surface of the charging roller 8, which are transferred onto the charging roller 8 from the photoreceptor 1. The surface of the photoreceptor 1 is uniformly charged by applying a voltage to a metallic core 11 of the charging roller 8 from a high-voltage power supply 12.

Figure 2B:
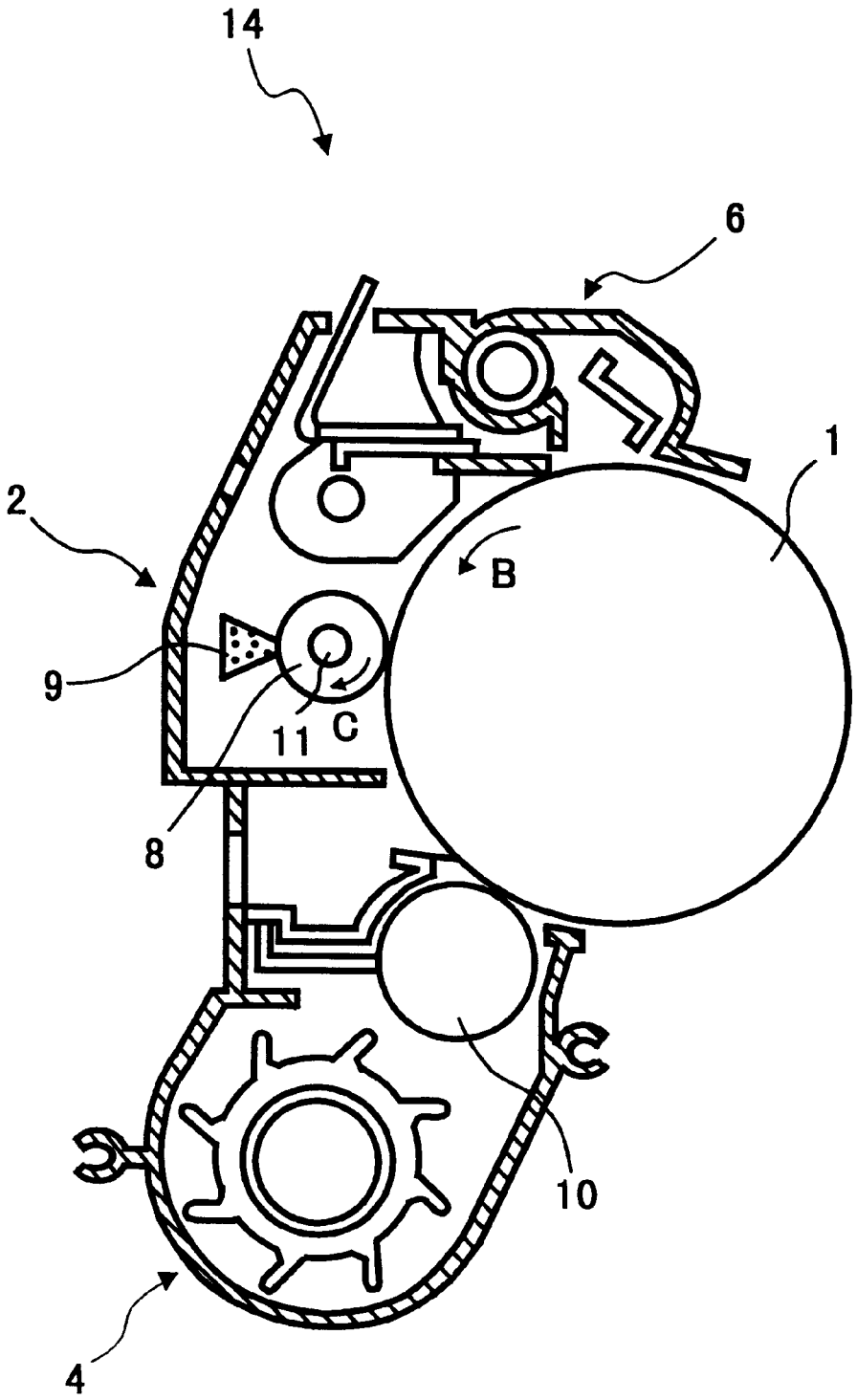
FIG. 2B is a schematic view illustrating an electrophotographic image forming process cartridge including the charging device of the present invention.

As illustrated in FIGS. 2A and 2B, the photoreceptor 1, the charging device 2, the developing device 4, and the cleaning device 6 are integrally accommodated in an electrophotographic image forming process cartridge 14 so as to reduce the total size of the image forming apparatus. The electrophotographic image forming process cartridge 14 is detachably attachable to the image forming apparatus. Alternatively, the electrophotographic image forming process cartridge 14 may integrally accommodate the charging device 2 and the at least one of the photoreceptor 1, the developing device 4, and the cleaning device 6.

When an image forming operation starts, the photoreceptor 1 is rotated in the direction indicated by the arrow B. Then, the surface of the photoreceptor 1 is discharged with a discharging light emitted from the discharging lamp 7 and the surface potential of a discharged part of the photoreceptor 1 is equalized to a standard voltage of 0V to −150V. Then, the photoreceptor 1 is charged by an application of voltage to the charging roller 8 contacting the surface of the rotating photoreceptor 1. Thus, the surface potential of the photoreceptor 1 is charged to a voltage of approximately −1,000V.

The laser light L is emitted from the exposing device 3 to the charged surface of the photoreceptor 1. Therefore, by the illumination of the laser light L, the surface potential of an image part of the surface of the photoreceptor 1 is charged to a voltage of approximately 0V to −200V, and thereby a latent image is formed. When the latent image is moved to the developing device 4 by the rotation of the photoreceptor 1 in the direction indicated by arrow B, the toner on a developing sleeve 10 of the developing device 4 is attracted to the latent image on the photoreceptor 1, and thereby a visible toner image is formed. Then, the toner image formed on the photoreceptor 1 moves to a transfer station where the photoreceptor 1 contacts the transfer belt 5 by the rotation of the photoreceptor 1.

A transfer sheet P is fed from a sheet feeding section (not shown) and is conveyed by a pair of registration rollers 13 such that a leading edge of the transfer sheet P reaches the transfer station with timing in synchronization with a leading edge of the toner image formed on the photoreceptor 1. Then, the toner image on the photoreceptor 1 is transferred to the transfer sheet P by applying a voltage to the transfer belt 5. Subsequently, the transfer sheet P is conveyed to a fixing section (not shown) and the toner image is melted and fixed on the transfer sheet P by application of heat and pressure. Thereafter, the transfer sheet P is discharged to a sheet discharging tray (not shown). The residual toner remaining on the photoreceptor 1 after the transfer operation is removed from the surface of the photoreceptor 1 by the cleaning device 6 and the surface of the photoreceptor 1 is discharged by the discharging lamp 7. Thereafter, the image forming process is repeated.

In the above-described image forming process, respective end portions 8*a* and 8*b* in a longitudinal direction of the charging roller 8 are illustrated in FIG. 1 and may be stained by scattered toner dropped from end portions of the cleaning device 6. As far as the scattering toner is not caused to enter a width portion of the charging roller 8 corresponding to an effective development area of the photoreceptor 1 (the effective development area of the photoreceptor 1 being defined by diagonal lines in FIG. 1), image quality is not deteriorated. However, when a scattering of toner such as an aggregated small amount of toner mass is dropped from the cleaning device 6 onto respective end portions 8*a* and 8*b* of the charging roller 8, and when the charging roller 8 is rotated by rotation of the photoreceptor 1, the aggregated small amount of toner mass may be pressed and spread in an axial direction of the charging roller 8 indicated by double-headed arrow A in FIG. 1 by the pressure between the charging roller 8 and the charging roller cleaning member 9 into the width portion of the part of the charging roller 8 corresponding to the effective development area of the photoreceptor 1. Specifically, when scattered toner such as an aggregated small toner mass is dropped on the charging roller 8, the amount of toner exceeds a predetermined amount which can be held by the charging roller cleaning member 9, so that the charging roller cleaning member 9 cannot remove and hold the same therein. The toner remains on the charging roller 8 and is pressed and spread into the width of the part of the charging roller 8 corresponding to the effective development area of the photoreceptor 1 as described above.

Then, the toner is fused on the surface of the charging roller 8 due to frictional heat and thereby adheres thereto. This results in the deterioration of charging property of the charging roller 8. Thereby, deterioration of image quality, such as background fouling and density unevenness of toner image, occurs according to developing methods.

In order to prevent the above-described deterioration of charging property of the charging roller 8 caused by the scattering toner on respective end portions 8*a* and 8*b* of the charging roller 8, as illustrated in FIG. 1, a length portion L2 of the charging roller cleaning member 9 along the axial direction of the charging roller 8 is set to be equal to or greater than a width portion Wde of the effective development area in an axial direction of the photoreceptor 1 (hereinafter referred to as an effective development width portion Wde) in the charging device 2 according to the first preferred embodiment of the present invention. Moreover, the above-described length L2 of the charging roller cleaning member 9 is set to be smaller than a charging contact width portion Wch of the charging roller 8 with the photoreceptor 1 in the axial direction of the charging roller 8 and than a width portion Wex of the photoreceptor 1 in the axial direction thereof. The width portion Wch is set to be equal to or smaller than the width portion Wex. That is, the following relation is satisfied:

$$Wex \geqq Wch > L2 \geqq Wde$$

In the first preferred embodiment, for example, the width portion Wex is set to about 334 mm, the width portion Wch is set to about 314 mm, the length portion L2 is set to about 304 mm, and the width portion Wde is set to about 302 mm.

In the charging device 2 satisfying the above-described relation, even when a scattering of toner such as an aggregated small amount of toner mass is dropped from the end portions of the cleaning device 6 on respective end portions 8*a* and 8*b* of the charging roller 8, the toner is not pressed and spread by the pressure between the charging roller 8 and the charging roller cleaning member 9 into the width of the part of the charging roller 8 corresponding to the effective development area of the photoreceptor 1, due to the fact that the charging roller cleaning member 9 does not slidably contact the end portions 8*a* and 8*b*. As a result, the above-described deterioration of charging property of the charging roller 8 due to the scattering toner can be avoided. Further, because the charging roller cleaning member 9 is not likely to be stained by the aggregated small amount of toner mass on respective end portions 8*a* and 8*b* of the charging roller 8, the durability of the charging roller cleaning member 9 can be improved.

In the charging device 2 according to the first preferred embodiment of the present invention, the charging roller cleaning member 9 is made of a sponge that is superior in holding property. Therefore, the charging roller cleaning member 9 can remove a large amount of toner on the surface of the charging roller 8.

Figure 3:
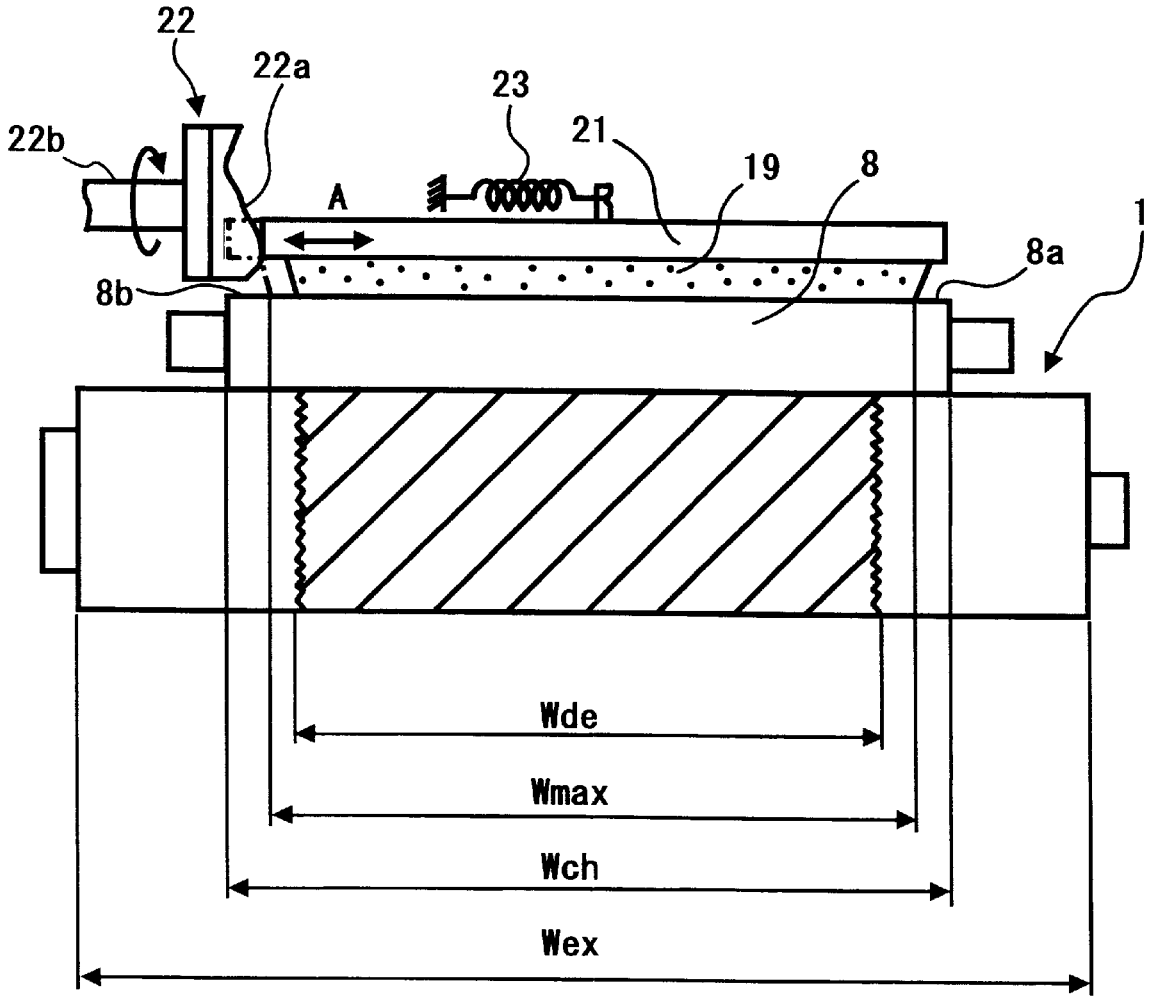
FIG. 3 is a schematic view illustrating a charging device and a photoreceptor according to a second preferred embodiment of the present invention.
Figure 4:
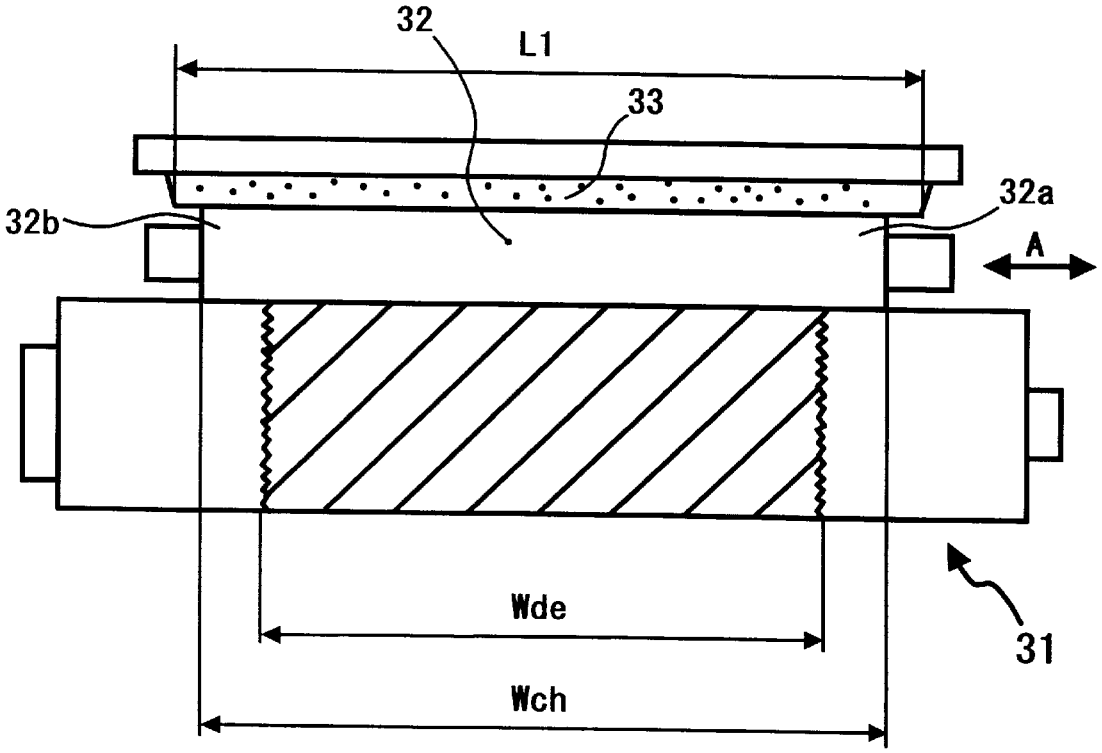
FIG. 4 BACKGROUND ART
FIG. 4 is a schematic view illustrating a background charging device and a photoreceptor.

FIG. 3 is a schematic view illustrating a charging device and a photoreceptor according to a second preferred embodiment of the present invention. For the sake of clarity, members having substantially the same functions as those used in the first preferred embodiment of the present invention will be designated with the same reference number and their description will be omitted. In the charging device according to the second preferred embodiment of the present invention, a charging roller cleaning member 19 constantly contacts the surface of the charging roller 8 under pressure and reciprocates in the axial direction of the charging roller 8 indicated by double-headed arrow A in FIG. 3 so as to clean the surface of the charging roller 8.

A rocking cam 22 is rotatably provided in the vicinity of one end of a holding member 21 that integrally holds the charging roller cleaning member 19. The holding member 21 is biased toward the rocking cam 22 by a spring 23 such that the one end of the holding member 21 abuts a cam surface 22*a* of the rocking cam 22. A shaft 22*b* of the rocking cam 22 is driven to rotate by a motor (not shown), and thereby the holding member 21 and the charging roller cleaning member 19 are reciprocated together in the direction indicated by double-headed arrow A in FIG. 3 contacting each other.

By reciprocating movements of the charging roller cleaning member 19, foreign substances, such as toner and paper powder, on the charging roller 8 can be held in a wider portion of the charging roller cleaning member 19.

In the charging device according to the second preferred embodiment, as illustrated in FIG. 3, a maximum contact width portion Wmax of the charging roller cleaning member 19 with the charging roller 8 along the axial direction of the charging roller 8 is set to be equal to or greater than the width portion Wde of the effective development area in the axial direction of the photoreceptor 1 (the effective development area of the photoreceptor 1 is defined by diagonal lines in FIG. 3). Further, the above-described maximum contact width portion Wmax is set to be smaller than the charging contact width portion Wch of the charging roller 8 with the photoreceptor 1 in the axial direction of the charging roller 8 and than the width portion Wex of the photoreceptor 1 in the axial direction thereof. The width portion Wch is set to be equal to or smaller than the width portion Wex. That is, the following relation is satisfied:

$$Wex \geqq Wch > Wmax \geqq Wde$$

In the second preferred embodiment, for example, the width portion Wex is set to about 334 mm, the charging contact width portion Wch is set to about 314 mm, the maximum contact width portion Wmax is set to about 308 mm, and the width portion Wde is set to about 302 mm.

In the charging device satisfying the above-described relation in which the charging roller cleaning member 19 constantly contacts the surface of the charging roller 8 with a pressure and reciprocates in the axial direction of the charging roller 8 so as to clean the surface of the charging roller 8, even when a scattering toner such as an aggregated small amount of toner mass is dropped from the end portions of the cleaning device 6 on respective end portions 8*a* and 8*b* of the charging roller 8, the toner is not pressed and spread by the pressure between the charging roller 8 and the charging roller cleaning member 19 and is not moved into the width portion of the part of the charging roller 8 corresponding to the effective development area of the photoreceptor 1 by the reciprocating charging roller cleaning member 19, because the charging roller cleaning member 19 does not slidably contact the end portions 8*a* and 8*b*. As a result, the above-described deterioration of charging property of the charging roller 8 due to the scattering toner can be avoided. Further, because the charging roller cleaning member 19 is not likely to be stained by the aggregated small amount of toner mass on respective end portions 8*a* and 8*b* of the charging roller 8, the durability of the charging roller cleaning member 19 can be improved.

Also in the charging device according to the second preferred embodiment of the present invention, the charging roller cleaning member 19 is made of a sponge that is superior in holding property. Therefore, the charging roller cleaning member 19 can remove a large amount of toner on the surface of the charging roller 8.

Numerous additional modifications and variations of the present invention are possible in light of the above teachings. It is therefore to be understood that within the scope of the appended claims, the present invention may be practiced otherwise than as specifically described herein.

This document claims priority and contains subject matter related to Japanese Patent Application No. 11-214729 filed in the Japanese Patent Office on Jul. 29, 1999, the entire contents of which are incorporated by reference.

What is claimed as new and is desired to be secured by Letters Patent of the United States is:

1. A charging device for charging a photoreceptor of an image forming apparatus so that a latent image is formed thereupon to be developed by toner, the charging device comprising:

a charging roller for constantly contacting the photoreceptor with pressure so as to be rotated by rotation of the photoreceptor, said charging roller charging the photoreceptor; and a charging roller cleaning member for constantly contacting a surface of the charging roller with pressure so as to remove toner transferred onto the charging roller from the photoreceptor, wherein a length portion of the charging roller cleaning member along an axial direction of the charging roller is set to be equal to or greater than a width portion of an effective development area in an axial direction of the photoreceptor and smaller than a charging contact width portion of the charging roller with the photoreceptor in the axial direction of the charging roller.

2. A charging device for charging a photoreceptor of an image forming apparatus so that a latent image is formed thereupon to be developed by toner, the charging device comprising:

a charging roller for constantly contacting the photoreceptor with pressure so as to be rotated by rotation of the photoreceptor, said charging roller charging the photoreceptor; and a charging roller cleaning member for constantly contacting a surface of the charging roller with pressure and for reciprocating in an axial direction of the charging roller so as to remove toner transferred onto the charging roller from the photoreceptor, wherein a maximum contact width portion of the charging roller cleaning member with the charging roller along the axial direction of the charging roller is set to be equal to or greater than a width portion of an effective development area in an axial direction of the photoreceptor and smaller than a charging contact width portion of the charging roller with the photoreceptor in the axial direction of the charging roller.

3. The charging device according to claim 1, wherein the charging roller cleaning member comprises a sponge material.

4. The charging device according to claim 2, wherein the charging roller cleaning member comprises a sponge material.

5. An electrophotographic image forming process cartridge for use in an image forming apparatus, comprising:

at least one of a rotatable photoreceptor for bearing a latent image to be developed by toner, a developing device for developing the latent image by the toner so as to form a toner image on the photoreceptor, and a cleaning device for removing residual toner remaining on a surface of the photoreceptor; and a charging device for charging the photoreceptor so that the latent image is formed thereupon to be developed by the toner, the charging device including, a charging roller for constantly contacting the photoreceptor with pressure so as to be rotated by rotation of the photoreceptor, said charging roller charging the photoreceptor; and a charging roller cleaning member for constantly contacting a surface portion of the charging roller with pressure so as to remove the toner transferred onto the charging roller from the photoreceptor, wherein a length portion of the charging roller cleaning member along an axial direction of the charging roller is set to be equal to or greater than a width portion of an effective development area in an axial direction of the photoreceptor and smaller than a charging contact width portion of the charging roller with the photoreceptor in the axial direction of the charging roller, wherein the charging device and the at least one of the photoreceptor, the developing device, and the cleaning device are integrally accommodated in the electrophotographic image forming process cartridge, and wherein the electrophotographic image forming process cartridge is detachably attachable to the image forming apparatus.

6. An electrophotographic image forming process cartridge for use in an image forming apparatus, comprising:

at least one of a rotatable photoreceptor for bearing a latent image to be developed by toner, a developing device for developing the latent image by the toner so as to form a toner image on the photoreceptor, and a cleaning device for removing residual toner remaining on a surface of the photoreceptor; and a charging device for charging the photoreceptor so that the latent image is formed thereupon to be developed by the toner, the charging device including, a charging roller that for constantly contacting the photoreceptor with pressure so as to be rotated by rotations of the photoreceptor, said charging roller charging the photoreceptor; and a charging roller cleaning member for constantly contacting a surface of the charging roller with pressure and for reciprocating in an axial direction of the charging roller so as to remove the toner transferred onto the charging roller from the photoreceptor, wherein a maximum contact width portion of the charging roller cleaning member with the charging roller along the axial direction of the charging roller is set to be equal to or greater than a width portion of an effective development area in an axial direction of the photoreceptor and smaller than a charging contact width portion of the charging roller with the photoreceptor in the axial direction of the charging roller, wherein the charging device and said at least one of the photoreceptor, the developing device, and the cleaning device are integrally accommodated in the electrophotographic image forming process cartridge, and wherein the electrophotographic image forming process cartridge is detachably attachable to the image forming apparatus.

7. The electrophotographic image forming process cartridge according to claim 5, wherein the charging roller cleaning member comprises a sponge material.

8. The electrophotographic image forming process cartridge according to claim 6, wherein the charging roller cleaning member comprises a sponge material.

9. An image forming apparatus comprising:

a rotatable photoreceptor for bearing a latent image to be developed by toner;

a charging roller for constantly contacting the photoreceptor with a pressure so as to be rotated by rotation of the photoreceptor, said charging roller charging the photoreceptor; and a charging roller cleaning member for constantly contacting a surface of the charging roller with a pressure so as to remove the toner transferred onto the charging roller from the photoreceptor, wherein a length portion of the charging roller cleaning member along an axial direction of the charging roller is set to be equal to or greater than a width portion of an effective development area in an axial direction of the photoreceptor and smaller than a charging contact width portion of the charging roller with the photoreceptor in the axial direction of the charging roller.

10. An image forming apparatus comprising:

a rotatable photoreceptor for bearing a latent image to be developed by toner;

a charging roller for constantly contacting the photoreceptor with a pressure so as to be rotated by rotation of the photoreceptor, said charging roller charging the photoreceptor; and a charging roller cleaning member for constantly contacting a surface of the charging roller with a pressure and to reciprocate in an axial direction of the charging roller so as to remove the toner transferred onto the charging roller from the photoreceptor, wherein a maximum contact width portion of the charging roller cleaning member with the charging roller along the axial direction of the charging roller is set to be equal to or greater than a width portion of an effective development area in an axial direction of the photoreceptor and smaller than a charging contact width portion of the charging roller with the photoreceptor in the axial direction of the charging roller.

11. The image forming apparatus according to claim 9, wherein the charging roller cleaning member comprises a sponge material.

12. The image forming apparatus according to claim 10, wherein the charging roller cleaning member comprises a sponge material.

13. A charging device for charging a photoreceptor of an image forming apparatus so that a latent image is formed thereupon to be developed by toner, the charging device comprising:

means for charging the photoreceptor, the charging means constantly contacting the photoreceptor with pressure so as to be rotated by rotation of the photoreceptor; and means for removing the toner transferred onto the charging means from the photoreceptor, the removing means constantly contacting a surface of the charging means with pressure, wherein a length portion of the removing means along an axial direction of the charging means is set to be equal to or greater than a width portion of an effective development area in an axial direction of the photoreceptor and smaller than a charging contact width portion of the charging means with the photoreceptor in the axial direction of the charging means.

14. A charging device for charging a photoreceptor of an image forming apparatus so that a latent image is formed thereupon to be developed by toner, the charging device comprising:

means for charging the photoreceptor, the charging means constantly contact the photoreceptor with pressure so as to be rotated by rotation of the photoreceptor; and means for removing the toner transferred onto the charging means from the photoreceptor, the removing means constantly contacting a surface of the charging means with pressure and reciprocating in an axial direction of the charging means, wherein a maximum contact width portion of the removing means with the charging means along the axial direction of the charging means is set to be equal to or greater than a width portion of an effective development area in an axial direction of the photoreceptor and smaller than a charging contact width portion of the charging means with the photoreceptor in the axial direction of the charging means.

15. An electrophotographic image forming process cartridge for use in an image forming apparatus, comprising:

at least one of means for bearing a latent image to be developed by toner, means for developing the latent image by the toner so as to form a toner image on the latent image bearing means, and means for removing residual toner remaining on a surface of the latent image bearing means; and means for charging the latent image bearing means so that the latent image is formed thereupon to be developed by the toner, the charging means including, a charging roller for constantly contacting the latent image bearing means with pressure so as to be rotated by rotation of the latent image bearing means, said charging roller charging the latent image bearing means; and a charging roller cleaning member for constantly contacting a surface of the charging roller with pressure so as to remove the toner transferred onto the charging roller from the latent image bearing means, wherein a length portion of the charging roller cleaning member along an axial direction of the charging roller is set to be equal to or greater than a width portion of an effective development area in an axial direction of the latent image bearing means and smaller than a charging contact width portion of the charging roller with the latent image bearing means in the axial direction of the charging roller, wherein the charging means and said at least one of the latent image bearing means, the developing means, and the removing means are integrally accommodated in the electrophotographic image forming process cartridge, and wherein the electrophotographic image forming process cartridge is detachably attachable to the image forming apparatus.

16. An electrophotographic image forming process cartridge for use in an image forming apparatus, comprising:

at least one of means for bearing a latent image to be developed by toner, means for developing the latent image by the toner so as to form a toner image on the latent image bearing means, and means for removing residual toner remaining on a surface of the latent image bearing means; and means for charging the latent image bearing means so that the latent image is formed thereupon to be developed by the toner, the charging means including, a charging roller for constantly contacting the latent image bearing means with a pressure so as to be rotated by rotation of the latent image bearing means, said charging roller charging the latent image bearing means; and a charging roller cleaning member for constantly contacting a surface of the charging roller with pressure and for reciprocating in an axial direction of the charging roller so as to remove the toner transferred onto the charging roller from the latent image bearing means, wherein a maximum contact width portion of the charging roller cleaning member with the charging roller along the axial direction of the charging roller is set to be equal to or greater than a width portion of an effective development area in an axial direction of the latent image bearing means and smaller than a charging contact width portion of the charging roller with the latent image bearing means in the axial direction of the charging roller, wherein the charging means and said at least one of the latent image bearing means, the developing means, and the removing means are integrally accommodated in the electrophotographic image forming process cartridge, and wherein the electrophotographic image forming process cartridge is detachably attachable to the image forming apparatus.

17. An image forming apparatus comprising:

means for bearing a latent image to be developed by toner, the latent image bearing means being rotatable;

means for charging the photoreceptor, the charging means constantly contacting the photoreceptor with pressure so as to be rotated by rotation of the photoreceptor; and means for removing the toner transferred onto the charging means from the photoreceptor, the removing means constantly contacting a surface of the charging means with pressure, wherein a length portion of the removing means along an axial direction of the charging means is set to be equal to or greater than a width portion of an effective development area in an axial direction of the photoreceptor and smaller than a charging contact width portion of the charging means with the photoreceptor in the axial direction of the charging means.

18. An image forming apparatus comprising:

means for bearing a latent image to be developed by toner, the latent image bearing means being rotatable;

means for charging the photoreceptor, the charging means constantly contacting the photoreceptor with pressure so as to be rotated by rotation of the photoreceptor; and means for removing the toner transferred onto the charging means from the photoreceptor, the removing means constantly contacting a surface of the charging means with pressure and reciprocating in an axial direction of the charging means, wherein a maximum contact width portion of the removing means with the charging means along the axial direction of the charging means is set to be equal to or greater than a width portion of an effective development area in an axial direction of the photoreceptor and smaller than a charging contact width portion of the charging means with the photoreceptor in the axial direction of the charging means.

19. A method of operating a charging device for charging a photoreceptor of an image forming apparatus so that a latent image is formed thereupon to be developed by toner, which comprises:

positioning a charging roller for constantly contacting the photoreceptor with pressure so as to be rotated by rotation of the photoreceptor, said charging roller charging the photoreceptor;

positioning a charging roller cleaning member for constantly contacting a surface of the charging roller with pressure so as to remove toner transferred onto the charging roller from the photoreceptor, and setting a length portion of the charging roller cleaning member along an axial direction of the charging roller so as to be equal to or greater than a width portion of an effective development area in an axial direction of the photoreceptor and smaller than a charging contact width portion of the charging roller with the photoreceptor in the axial direction of the charging roller.

20. A method of operating a charging device for charging a photoreceptor of an image forming apparatus so that a latent image is formed thereupon to be developed by toner, which comprises:

positioning a charging roller for constantly contacting the photoreceptor with pressure so as to be rotated by rotation of the photoreceptor, said charging roller charging the photoreceptor;

positioning a charging roller cleaning member for constantly contacting a surface of the charging roller with pressure and for reciprocating in an axial direction of the charging roller so as to remove toner transferred onto the charging roller from the photoreceptor; and setting a maximum contact width portion of the charging roller cleaning member with the charging roller along the axial direction of the charging roller so as to be equal to or greater than a width portion of an effective development area in an axial direction of the photoreceptor and smaller than a charging contact width portion of the charging roller with the photoreceptor in the axial direction of the charging roller.

21. The method according to claim 19, wherein the charging roller cleaning member comprises a sponge material.

22. The method according to claim 20, wherein the charging roller cleaning member comprises a sponge material.

23. A method of operating electrophotographic image forming process cartridge for use in an image forming apparatus, which comprises:

providing at least one of a rotatable photoreceptor for bearing a latent image to be developed by toner, a developing device for developing the latent image by the toner so as to form a toner image on the photoreceptor, and a cleaning device for removing residual toner remaining on a surface of the photoreceptor; and positioning a charging device for charging the photoreceptor so that the latent image is formed thereupon to be developed by the toner;

positioning a charging roller for constantly contacting the photoreceptor with pressure so as to be rotated by rotation of the photoreceptor, said charging roller charging the photoreceptor;

positioning a charging roller cleaning member for constantly contacting a surface portion of the charging roller with pressure so as to remove the toner transferred onto the charging roller from the photoreceptor;

setting a length portion of the charging roller cleaning member along an axial direction of the charging roller so as to be equal to or greater than a width portion of an effective development area in an axial direction of the photoreceptor and smaller than a charging contact width portion of the charging roller with the photoreceptor in the axial direction of the charging roller;

integrally accommodating the charging device and the at least one of the photoreceptor, the developing device, and the cleaning device in the electrophotographic image forming process cartridge, and a detachably attaching the electrophotographic image forming process cartridge to the image forming apparatus.

24. A method of operating electrophotographic image forming process cartridge for use in an image forming apparatus, which comprises:

providing at least one of a rotatable photoreceptor for bearing a latent image to be developed by toner, a developing device for developing the latent image by the toner so as to form a toner image on the photoreceptor, and a cleaning device for removing residual toner remaining on a surface of the photoreceptor; and positioning a charging device for charging the photoreceptor so that the latent image is formed thereupon to be developed by the toner;

positioning a charging roller for constantly contacting the photoreceptor with pressure so as to be rotated by rotation of the photoreceptor, said charging roller charging the photoreceptor; and positioning a charging roller cleaning member for constantly contacting a surface of the charging roller with pressure and for reciprocating in an axial direction of the charging roller so as to remove the toner transferred onto the charging roller from the photoreceptor, setting a maximum contact width portion of the charging roller cleaning member with the charging roller along the axial direction of the charging roller so as to be equal to or greater than a width portion of an effective development area in an axial direction of the photoreceptor and smaller than a charging contact width portion of the charging roller with the photoreceptor in the axial direction of the charging roller;

integrally accommodating the charging device and said at least one of the photoreceptor, the developing device, and the cleaning device in the electrophotographic image forming process cartridge, and detachably attaching the electrophotographic image forming process cartridge to the image forming apparatus.

25. The method of operating the electrophotographic image forming process cartridge according to claim 23, wherein the charging roller cleaning member comprises a sponge material.

26. The electrophotographic image forming process cartridge according to claim 24, wherein the charging roller cleaning member comprises a sponge material.

27. A method of operating image forming apparatus, which comprises:

positioning a rotatable photoreceptor for bearing a latent image to be developed by toner;

positioning a charging roller for constantly contacting the photoreceptor with pressure so as to be rotated by rotation of the photoreceptor, said charging roller charging the photoreceptor; and positioning a charging roller cleaning member for constantly contacting a surface of the charging roller with a pressure so as to remove the toner transferred onto the charging roller from the photoreceptor, setting a length portion of the charging roller cleaning member along an axial direction of the charging roller so as to be equal to or greater than a width portion of an effective development area in an axial direction of the photoreceptor and smaller than a charging contact width portion of the charging roller with the photoreceptor in the axial direction of the charging roller.

28. A method of operating image forming apparatus, which comprises:

providing a rotatable photoreceptor for bearing a latent image to be developed by toner;

positioning a charging roller for constantly contacting the photoreceptor with pressure so as to be rotated by rotation of the photoreceptor, said charging roller charging the photoreceptor; and positioning a charging roller cleaning member for constantly contacting a surface of the charging roller with a pressure and to reciprocate in an axial direction of the charging roller so as to remove the toner transferred onto the charging roller from the photoreceptor, and setting a maximum contact width portion of the charging roller cleaning member with the charging roller along the axial direction of the charging roller so as to be equal to or greater than a width portion of an effective development area in an axial direction of the photoreceptor and smaller than a charging contact width portion of the charging roller with the photoreceptor in the axial direction of the charging roller.

29. The image forming method according to claim 27, wherein the charging roller cleaning member comprises a sponge material.

30. The image forming apparatus according to claim 28, wherein the charging roller cleaning member comprises a sponge material.

31. A charging method for charging a photoreceptor of an image forming apparatus so that a latent image is formed thereupon to be developed by toner, which comprises:

providing means for charging the photoreceptor, the charging means constantly contacting the photoreceptor with pressure so as to be rotated by rotation of the photoreceptor; and providing means for removing the toner transferred onto the charging means from the photoreceptor, the removing means constantly contacting a surface of the charging means with pressure, and setting a length portion of the removing means along an axial direction of the charging means so as to be equal to or greater than a width portion of an effective development area in an axial direction of the photoreceptor and smaller than a charging contact width portion of the charging means with the photoreceptor in the axial direction of the charging means.

32. A method for charging a photoreceptor of an image forming apparatus so that a latent image is formed thereupon to be developed by toner, which comprises:

providing means for charging the photoreceptor, the charging means constantly contacting the photoreceptor with pressure so as to be rotated by rotation of the photoreceptor;

positioning means for removing the toner transferred onto the charging means from the photoreceptor, the removing means constantly contacting a surface of the charging means with pressure and reciprocating in an axial direction of the charging means; and setting a maximum contact width portion of the removing means with the charging means along the axial direction of the charging means so as to be equal to or greater than a width portion of an effective development area in an axial direction of the photoreceptor and smaller than a charging contact width portion of the charging means with the photoreceptor in the axial direction of the charging means.

33. An electrophotographic image forming process utilizing a cartridge for use in an image forming apparatus, which comprises:

providing at least one of means for bearing a latent image to be developed by toner, means for developing the latent image by the toner so as to form a toner image on the latent image bearing means, and means for removing residual toner remaining on a surface of the latent image bearing means; and providing positioning means for charging the latent image bearing means so that the latent image is formed thereupon to be developed by the toner, positioning a charging roller for constantly contacting the latent image bearing means with pressure so as to be rotated by rotation of the latent image bearing means, said charging roller charging the latent image bearing means;

positioning a charging roller cleaning member for constantly contacting a surface of the charging roller with pressure so as to remove the toner transferred onto the charging roller from the latent image bearing means, setting a length portion of the charging roller cleaning member along an axial direction of the charging roller so as to be equal to or greater than a width portion of an effective development area in an axial direction of the latent image bearing means and smaller than a charging contact width portion of the charging roller with the latent image bearing means in the axial direction of the charging roller;

integrally accommodating the charging means and said at least one of the latent image bearing means, the developing means, and the removing means in the electrophotographic image forming process cartridge, and detachably attaching the electrophotographic image forming process cartridge to the image forming apparatus.

34. An electrophotographic image forming process utilizing a cartridge for use in an image forming apparatus, which comprises:

providing at least one of means for bearing a latent image to be developed by toner, means for developing the latent image by the toner so as to form a toner image on the latent image bearing means, and means for removing residual toner remaining on a surface of the latent image bearing means;

providing positioning means for charging the latent image bearing means so that the latent image is formed thereupon to be developed by the toner;

positioning a charging roller for constantly contacting the latent image bearing means with a pressure so as to be rotated by rotation of the latent image bearing means, said charging roller charging the latent image bearing means; and positioning a charging roller cleaning member for constantly contacting a surface of the charging roller with pressure and for reciprocating in an axial direction of the charging roller so as to remove the toner transferred onto the charging roller from the latent image bearing means, setting a maximum contact width portion of the charging roller cleaning member with the charging roller along the axial direction of the charging roller so as to be equal to or greater than a width portion of an effective development area in an axial direction of the latent image bearing means and smaller than a charging contact width portion of the charging roller with the latent image bearing means in the axial direction of the charging roller;

integrally accommodating the charging means and said at least one of the latent image bearing means, the developing means, and the removing means in the electrophotographic image forming process cartridge, and detachably attaching the electrophotographic image forming process cartridge to the image forming apparatus.

35. An image forming method, which comprises:

providing means for bearing a latent image to be developed by toner, the latent image bearing means being rotatable;

positioning means for charging the photoreceptor, the charging means constantly contacting the photoreceptor with pressure so as to be rotated by rotation of the photoreceptor; and positioning means for removing the toner transferred onto the charging means from the photoreceptor, the removing means constantly contacting a surface of the charging means with pressure, and setting a length portion of the removing means along an axial direction of the charging means so as to be equal to or greater than a width portion of an effective development area in an axial direction of the photoreceptor and smaller than a charging contact width portion of the charging means with the photoreceptor in the axial direction of the charging means.

36. An image forming method which comprises:

providing means for bearing a latent image to be developed by toner, the latent image bearing means being rotatable;

positioning means for charging the photoreceptor, the charging means constantly contacting the photoreceptor with pressure so as to be rotated by rotation of the photoreceptor;

positioning means for removing the toner transferred onto the charging means from the photoreceptor, the removing means constantly contacting a surface of the charging means with pressure and reciprocating in an axial direction of the charging means; and setting a maximum contact width portion of the removing means with the charging means along the axial direction of the charging means so as to be equal to or greater than a width portion of an effective development area in an axial direction of the photoreceptor and smaller than a charging contact width portion of the charging means with the photoreceptor in the axial direction of the charging means.

37. A charging device as claimed in claim 1, wherein a width portion of the photoreceptor is substantially greater than the width portion of the effective development area.

38. An electrophotographic image forming process cartridge as claimed in claim 5, wherein a width portion of the photoreceptor is substantially greater than the width portion of the effective development area.

39. An image forming apparatus as claimed in claim 9, wherein a width portion of the photoreceptor is substantially greater than the width portion of the effective development area.

40. A charging device as claimed in claim 13, wherein a width portion of the photoreceptor is substantially greater than the width portion of the effective development area.

41. An electrophotographic image forming process cartridge as claimed in claim 15, wherein a width portion of the photoreceptor is substantially greater than the width portion of the effective development area.

42. An image forming apparatus as claimed in claim 17, wherein a width portion of a photoreceptor is substantially greater than the width portion of the effective development area.

43. The image forming method according to claim 19, which comprises setting a width portion of the photoreceptor so as to be substantially greater than the width portion of the effective displacement area.

44. The method according to claim 23, which comprises setting a width portion of the photoreceptor so as to be substantially greater than the width portion of the effective development area.

45. The method claimed in claim 27, which comprises setting a width portion of the photoreceptor so as to be substantially greater than the width portion of the effective development area.

46. The charging method as claimed in claim 31, which comprises setting the width portion of the photoreceptor so as to be substantially greater than the width portion of the effective development area.

47. The electrophotographic image forming process according to claim 33, which comprises setting a width portion of the photoreceptor so as to be substantially greater than the width portion of the effective development area.

48. The method as claimed in claim 35, which comprises setting a width portion of the photoreceptor so as to be substantially greater than the width portion of the effective development area.

* * * * *